United States Patent [19]

Keable et al.

[11] 4,198,996

[45] Apr. 22, 1980

[54] PORTABLE CAMPER

[76] Inventors: Denis Keable, 215 Horace St.; Claude Prefontaine, 103-1010 Brazier St., both of Winnipeg, Manitoba, Canada

[21] Appl. No.: 915,480

[22] Filed: Jun. 14, 1978

[30] Foreign Application Priority Data

Mar. 31, 1978 [CA] Canada ..... 300243

[51] Int. Cl.[2] ..... A45F 1/06

[52] U.S. Cl. ..... 135/1 A; 135/4 A; 135/5.1

[58] Field of Search ..... 135/DIG. 6, 1 R, 1 A, 135/5 A, 5.1; 5/11, 112, 113, 116, 117, 186 R, 187

[56] References Cited

U.S. PATENT DOCUMENTS

| | | | |
|---|---|---|---|
| 1,836,060 | 12/1931 | Barnes | 135/DIG. 6 |
| 2,239,951 | 4/1941 | Bromschwig | 5/113 |
| 2,299,382 | 10/1942 | Creasy | 135/1 A |
| 3,115,362 | 12/1963 | Spurrier | 135/1 A |
| 3,228,405 | 1/1966 | Bursey | 135/1 A |
| 3,933,164 | 1/1976 | Ness | 135/DIG. 6 |

*Primary Examiner*—Reinaldo P. Machado
*Attorney, Agent, or Firm*—Barrigar & Oyen

[57] ABSTRACT

This invention relates to a tent which may be transported in an automobile trunk suitable for camping which comprises a frame comprised of first and second end members and two side members, each of the side members being of adjustable length to permit the distance between the end members to be varied and a first frame support means, upon which the first end members rests, adapted to be secured to a transportation vehicle; and a second support means hingedly connected to the second end member, such that in a compressed position it lies in substantially the same plane as the frame, and in an extended position supports the second end member, the second support means being adjustable such that the second end member may be maintained at the same elevation as the first end member.

2 Claims, 6 Drawing Figures

FIG. 5
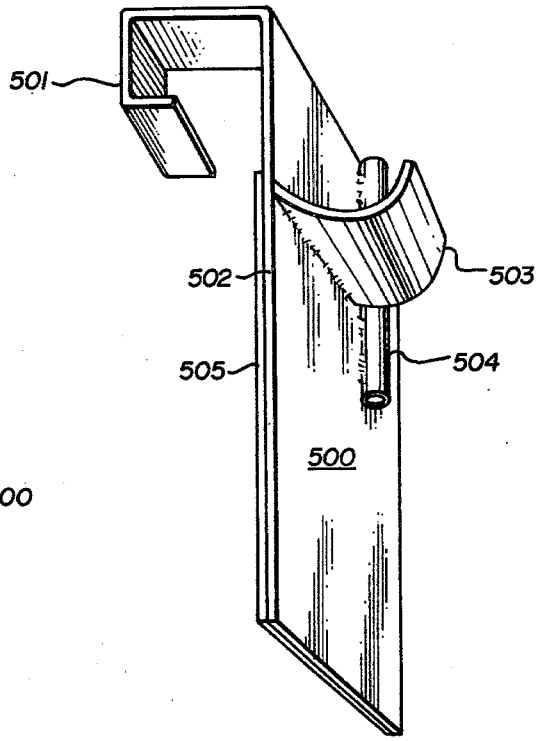
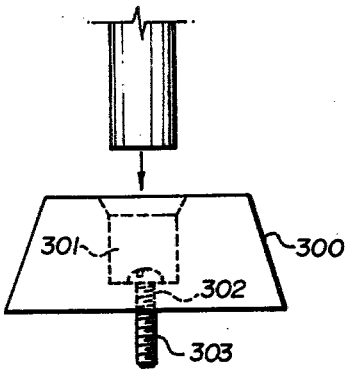
FIG. 3
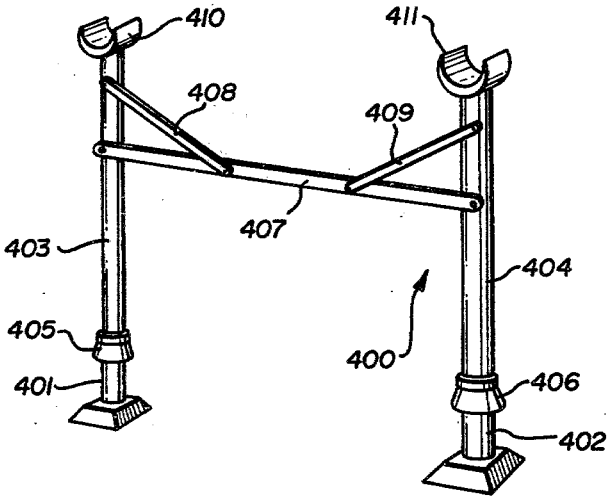
FIG. 4

PORTABLE CAMPER

This invention relates to a tent which may be transported in an automobile trunk suitable for camping.

BACKGROUND OF THE INVENTION

Commonly, camping tents consist of a large number of parts which require substantial time and effort to erect. Generally, commonly available tents which are transported disassembled on the roof of an automobile, or in its trunk, once erected, rest on the ground thus requiring the use of ground sheets, air mattresses, and the like, to keep out the dampness and chill from the ground, and smooth out the generally uneven terrain.

The susceptability of most ordinary tents to dampness from the ground makes them somewhat uncomfortable at all times and even less comfortable during the cool seasons in Canada. The outdoor camping shelters which offer a floor off the cold ground are generally bulky, expensive and often must be towed behind an automobile or truck. While these types of outdoor shelters are more readily adapted to cold weather camping, they are considerably more expensive than the traditional tent, and relatively complex to erect.

SUMMARY OF THE INVENTION

This invention overcomes or reduces these difficulties by providing a camper tent which, in its storage configuration, may easily be transported in the trunk of a car, quickly assembled and erected, and once erected offers the user a shelter sufficiently elevated above ground to avoid the dampness and cold from the ground and the discomfort of uneven terrain. This is achieved through the use of a rigid telescoping frame supported at one end by the bumper of a vehicle and the other end by a support frame of adjustable height which is hinged to the end of the frame so that it can be swung into the plane of the frame for storage. In addition a removable centre support frame is provided for extra strength.

In particular the invention relates to a camper frame comprising a frame which is in turn comprised of two end members and two side members, each of such side members being of adjustable length to permit the distance between said end members to be varied. The frame is supported by said first end member by a means adapted to be secured to a transportation vehicle and a second support means hingedly connected to the second end member, such that in a compressed position it lies in substantially the same plane as the frame and in an extended position supports said end member and is adjustable such that the second end member may be maintained at the same elevation as said first end member.

The camper frame may also include a means for supporting the frame at points intermediate the two end members.

The camper frame may in fact be rectangular and support from the end and side members a flexible sheet of rectangularly shaped materal which is enclosed within the rectangular frame.

Finally the camper frame is adapted with means to support a protective canopy.

IN THE DRAWINGS

In drawings which illustrate one of the embodiments of the invention;

FIG. 3 is a partly sectional view of the foot pad illustrating the position of a leg end and the protruding threaded spike.

FIG. 4 is an elevation view of the centre support frame.

FIG. 5 is a three-dimensional view of a bumper bracket used to support the head end of the bed frame.

DETAILED DESCRIPTION

Figure 1:
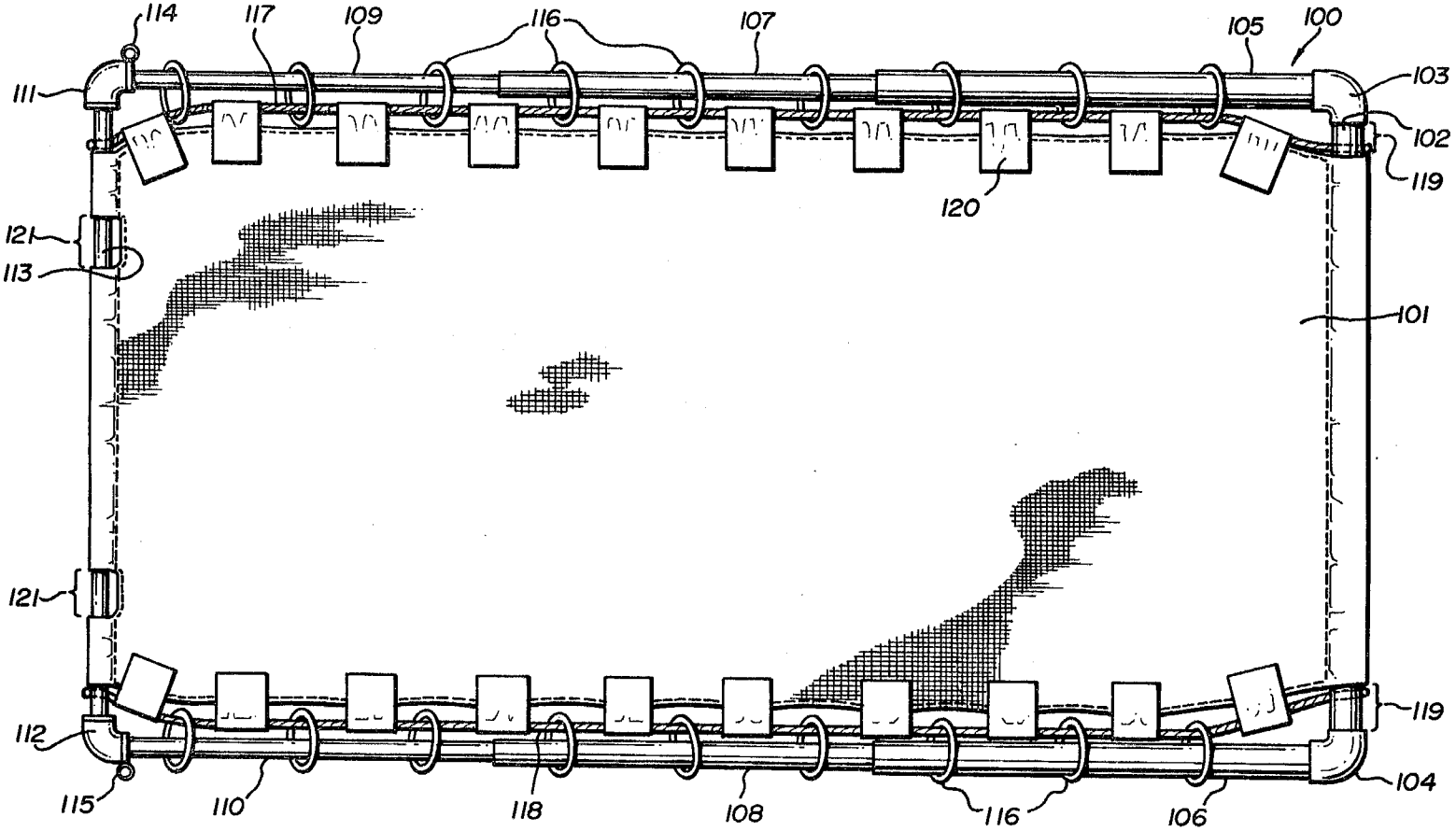
FIG. 1 is a top plan view of the telescoping camper frame in its extended position.

Referring to the drawings, FIG. 1 illustrates how the telescoping frame 100 is fitted with a canvas sheet 101 to form the floor of the camper. The telescoping frame 100 comprises a tubular structural head member 102 which accepts at each extremity one arm of corner elbows 103 and 104. The free arm of each of the corner elbows 103 and 104 fits into tubular member 105 and 106 respectively. Tubular members 105 and 106 accept tubular members 107 and 108 which are of a diameter such that they freely slide within tubular members 105 and 106 without an undue amount of play. Tubular members 107 and 108 accept tubular members 109 and 110 which are of a diameter such that they freely slide within tubular members 107 and 108 without an undue amount of play.

In the result, tubular member 109 telescopes within tubular member 107 which telescopes within tubular member 105. Similarly, tubular member 110 telescopes within tubular member 108 which telescopes within tubular member 106.

The end of tubular member 109 not in contact with tubular member 107 is accepted into one arm of corner elbow 111. Likewise, the end of tubular member 110 not in contact with tubular member 108 is accepted into one arm of corner elbow 112. Tubular foot member 113, parallel to and substantially equal in length to tubular head member 102, is accepted at one end into the other arm of corner elbow 111 and at the other end in the other arm of corner elbow 112.

In the result, telescoping frame 100 is substantially rectangular and is contractable to a first position where tubular members 109, 107 and 105, and tubular members 110, 108 and 106 fit substantially within each other, and a second position in which said tubular members are fully extended. It will be appreciated that when the members are fully extended, there is still sufficient overlap remaining to provide substantial strength to the frame.

Tubular receiving pipes 114 and 115 are respectively fastened on the outer periphery of telescoping frame 100 to the arms of corner elbow 111 and 112, which accept tubular members 108 and 110, such that their longitudinal axis is orthogonal to the plane of telescoping frame 100.

A plurality of rings 116 are concentrically placed over tubular members 105 to 110 of a diameter such that they are free to slide over said members. Cables 117 and 118 are threaded through the rings 116 along tubular members 105, 107 and 109 and 106, 108 and 110, secured at one end to tubular head member 102 at points adjacent to corner elbows 103 and 104 and at the other to tubular foot member 113 at points adjacent to corner elbows 111 and 112.

Canvas sheet 101 is fastened to tubular head member 102 by forming a sleeve leaving said member exposed over gap 119 adjacent to corner elbows 103 and 104. Said canvas sheet 101 is supported along tubular members 105, 107 and 109, on the one side and 106, 108 and 110, on the other side by means of a plurality of straps 120 through which cables 117 and 118 are threaded. Canvas sheet 101 is fastened to tubular foot member 113 save for gaps 121 located between corner elbows 111 and 112 and the center of tubular member 113.

Figure 2:
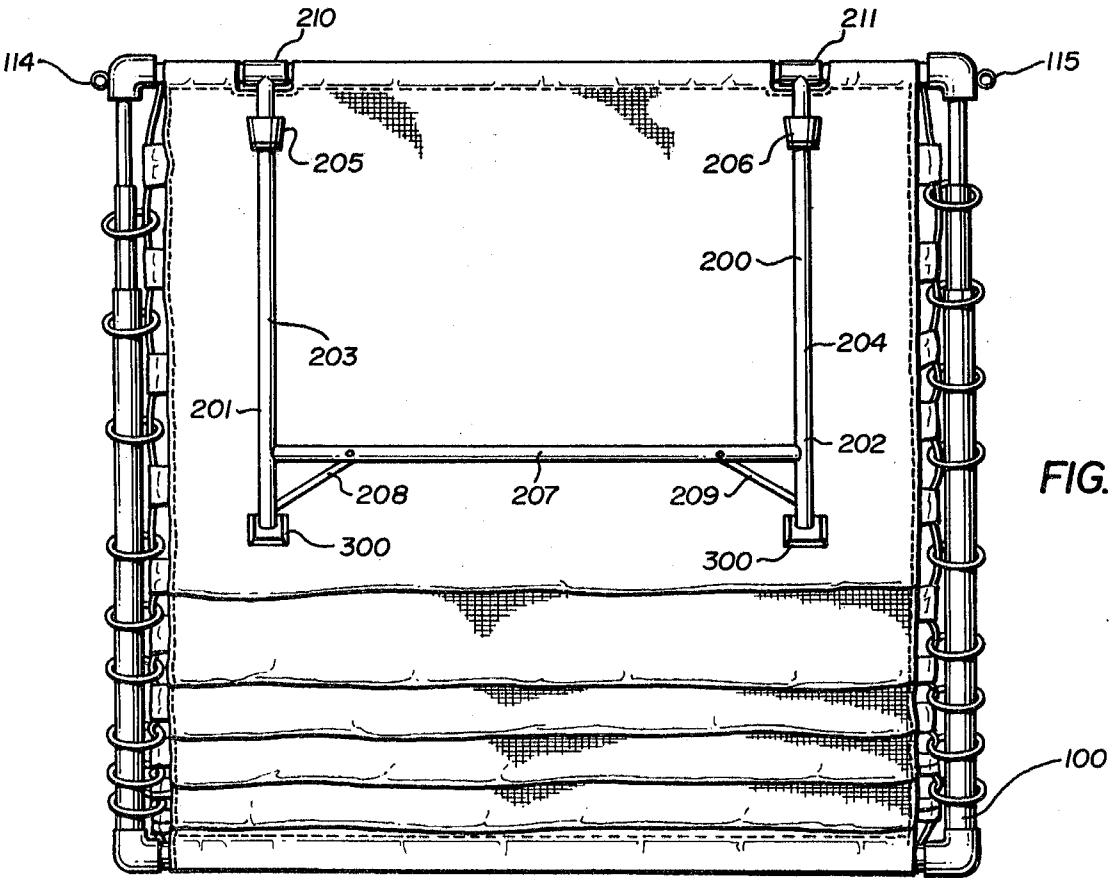
FIG. 2 is a top plan view of the telescoping camper frame in its contracted position with the end support frame in its storage position.

FIG. 2 illustrates the telescoping frame 100 in its contracted position with the foot support frame 200 in its storage position. Said foot support frame 200 comprises tubular members 201 and 202 which fit telescopically into tubular members 203 and 204 respectively. Locking means 205 and 206 are provided to prevent relative movement between tubular members 203 and 201, and 204 and 202 respectively. Cross piece 207 joins tubular members 203 and 204 to provide strength and to provide further strength is further fastened to tubular member 203 by brace 208 and to tubular member 204 by brace 209. The result of this is that said tubular members 203 and 204 are kept substantially parallel. Tubular members 203 and 204 are terminated by hinge pipes 210 and 211 which are centered on said tubular members 203 and 204 with coincident longitudinal axes normal to the axes of said tubular members 203 and 204. Hinge pipes 210 and 211 hinge on tubular foot member 113 in respective gaps 121 of the canvas sheet 101. The free end of tubular members 201 and 202 fit into identical foot pads 300.

FIG. 3 is a partly sectional view of foot pad 300. Said foot pad 300 comprises flared bore 301 which is adapted to receive a tubular leg member such as 201 and 202. Threaded bore 302 permits the adjustment of the length of protrusion of threaded spike 303. Threaded spike 303 penetrates into the ground to provide good stability.

The centre support frame 400, which supports the central portion of frame 100, is shown in FIG. 4. Tubular elements 401 and 402 fit telescopically into tubular members 403 and 404 respectively. Locking means 405 and 406 serve to prevent relative movement of said telescoping members. Cross piece 407 is fastened to tubular members 403 and 404 and also through braces 408 and 409 such that said tubular members 403 and 404 are kept substantially parallel and separated by the width of telescoping frame 100. Tubular members 403 and 404 are terminated by curved guide members 410 and 411 which are respectively fastened with their longitudinal axes orthogonal to the plane formed by tubular elements 403 and 404 and cross piece 407. Said guide members 410 and 411 are fashioned to accept tubular members 107 and 108 of telescoping frame 100. The free ends of tubular elements 401 and 402 are terminated by foot pads 300, as previously explained.

FIG. 5 illustrates bumper bracket 500. Said bracket is formed with channel 501 which grips the bumper of an automotive vehicle such that plate 502 of said bracket 500 is held in a substantially vertical plane. Attached to plate 502, with its longitudinal axis horizontal and parallel to the plane of said plate 502, is upwardly curving flange 503. Said curved flange 503 is designed to accept tubular member 102 at gap 119. Also fastened to plate 502, beside upwardly curving flange 503 and in a substantially vertical position, is tubular receiving pipe 504 which originates at the top of channel 501 and extends to a point below the base of upwardly curving flange 503. Felt pad 505, secured to plate 502, serves to protect the finish on the bumper.

Figure 6:
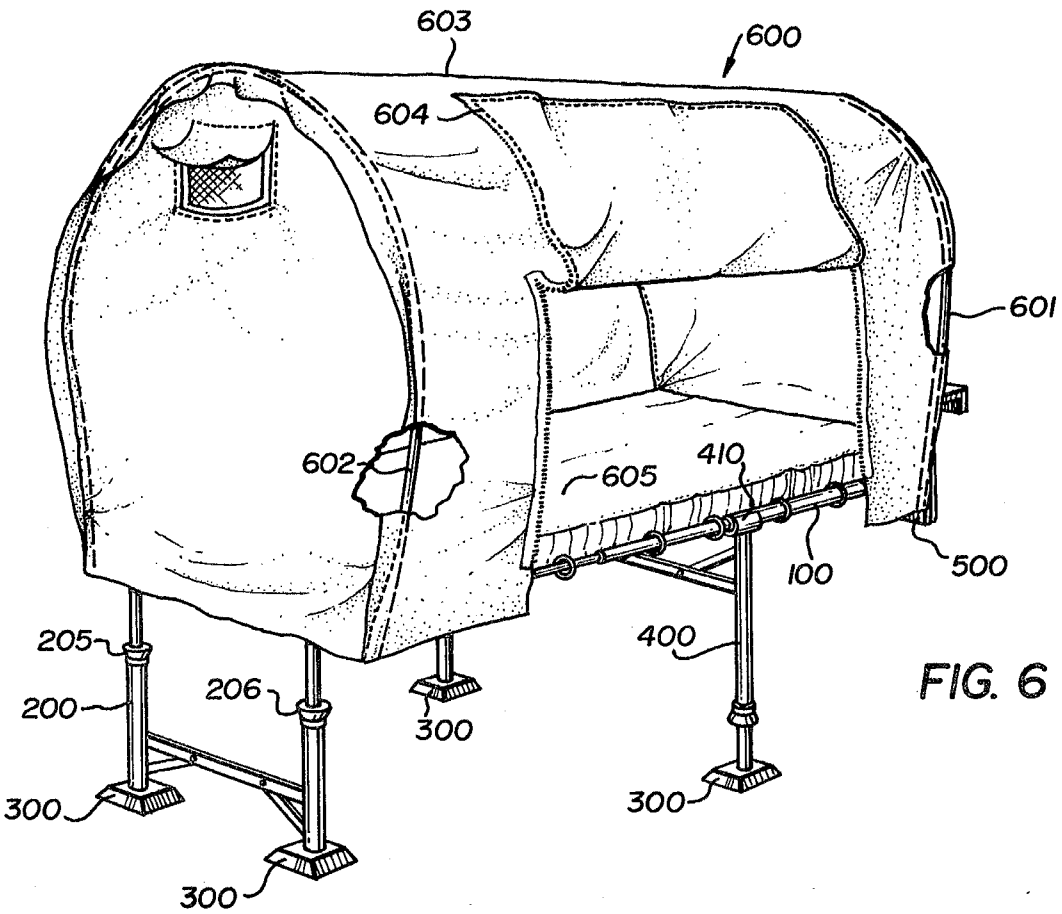
FIG. 6 is a three-dimensional view of the assembled portable camper illustrating the use of an enclosure in the form of a chuck wagon with a side flap.

FIG. 6 illustrates assembled camper 600. The user assembles said camper 600 by attaching two bumper brackets 500 to the bumper of a vehicle (not shown). The telescoping frame 100 is hooked onto the upwardly curving flanges 503 of bumper brackets 500 by means of tubular member 102 at gaps 119. Telescoping frame 100 is then extended to its limit, foot support frame 200 is swung downwardly into its vertical support position with its legs adjusted by means of locking means 205 and 206 to conform with uneven terrain and adjust the height of the frame above the ground to provide a level configuration to frame 100. Center support frame 400 is placed in the center of the telescoping frame 100 with its legs extending vertically downwardly with their length adjusted to conform with uneven terrain such that guide members 410 and 411 (not shown) receive tubular members 107 and 108 respectively and the frame 100 has an overall horizontal configuration. Tent or canopy poles 601 and 602 are inserted in tubular receiving pipes 504 in bumper brackets 500 and tubular receiving pipes 114 and 115 on telescoping frame 100 respectively to support canopy 603, which for illustration purposes is shown in the form of a chuck wagon. It will be recognized that other canopy shapes and designs are possible. Tent flap 604, which runs the length of the camper, permits easy access to the interior when the canopy 603 is erected. Foam pad 605, which covers canvas sheet 101, may be added to provide comfort and insulation.

In its knocked down (storage) configuration (not shown) all the parts may be placed in a box and stored in the vehicle trunk for portability.

Modifications and variants of the foregoing will readily occur to those skilled in the art. The invention is not to be construed as limited to the particulars of the proposals specifically described above, but is to be afforded the full scope defined by the accompanying claims.

What we claim is:

1. A camper frame, comprising:

(a) a frame of rectangular outline comprising parallel first and second end members and two parallel side members, each of said parallel side members being of telescopic construction and being of adjustable length to permit the distance between said parallel end members to be varied;

(b) a first frame support means, upon which said first end member rests, adapted to be secured to a transportation vehicle;

(c) a second support means hingedly connected to said second end member, such that in a compressed position it lies in substantially the same plane as said frame, and in an extended position supports said second end member, said second support means comprising a plurality of tubular elements, said tubular elements being telescopically adjustable in length such that said second end member may be supported from the ground and may be maintained at the same elevation as said first end member;

(d) a plurality of rings concentrically placed over said side members of said frame;

(e) a flexible sheet of generally rectangular configuration, said sheet further characterised by (i) fastening means at each end of said sheet for connecting the sheet to the two end members of the frame; and (ii) a plurality of straps attachable to the sides of the sheet; and (f) a plurality of cables for affixing said sheet to the side members of said frame by means of alternately threading said cables through said rings and said straps and affixing the ends of the cables to the end of members of the frame.

2. A camper frame as defined in claim 1, including means attached to said camper frame for supporting a protective canopy.

* * * * *